United States Patent [19]

Pileggi

[11] Patent Number: 4,458,676

[45] Date of Patent: Jul. 10, 1984

[54] PORTABLE SPA MASSAGER

[76] Inventor: Vincent D. Pileggi, 1023 Whittier Blvd., Anaheim, Calif. 92803

[21] Appl. No.: 447,326

[22] Filed: Dec. 6, 1982

[51] Int. Cl.[3] ..... A61H 7/00

[52] U.S. Cl. ..... 128/53; 128/50; 128/66

[58] Field of Search ..... 128/64, 65, 66, 52, 128/365-369, 37, 39-53, 56, 57, 60, 61, 67; 4/606, 492, 541, 542; 74/50, 421 R, 421 A; 15/29, 22 R, 176, 180, 400

[56] References Cited

U.S. PATENT DOCUMENTS

| | | | |
|---|---|---|---|
| 1,038,656 | 9/1912 | Reuter | 128/66 |
| 2,026,981 | 1/1936 | Kahnt | 4/606 |
| 2,068,757 | 1/1937 | Mishelle | 4/606 |
| 2,905,171 | 9/1959 | DeCrescenzo | 128/53 |
| 3,084,069 | 4/1963 | Simon | 15/29 |
| 3,088,149 | 5/1963 | Potenza | 15/29 |
| 3,195,537 | 7/1965 | Blasi | 15/29 |
| 3,313,296 | 4/1967 | Ruuska | 128/51 |
| 3,420,226 | 1/1969 | Berry, Sr. | 128/369 |
| 3,494,353 | 2/1970 | Marich | 128/46 |
| 3,566,703 | 3/1971 | Van Noord | 74/50 |
| 3,584,172 | 6/1971 | Owen | 74/50 |
| 3,724,451 | 4/1973 | Santo | 128/52 |
| 3,809,073 | 5/1974 | Baumann | 4/542 |
| 3,864,780 | 2/1975 | Watkins | 15/29 |
| 3,943,921 | 3/1976 | Colk | 128/65 |
| 3,962,924 | 6/1976 | Glover et al. | 74/50 |
| 4,115,878 | 9/1978 | Johnson et al. | 128/66 |
| 4,139,001 | 2/1979 | Macabee | 128/64 |
| 4,272,996 | 6/1981 | Saverwein | 74/50 |
| 4,282,623 | 8/1981 | Gacvzana | 15/29 |
| 4,358,862 | 11/1982 | Altman et al. | 4/542 |

FOREIGN PATENT DOCUMENTS

| | | | |
|---|---|---|---|
| 616075 | 3/1980 | Switzerland | 128/50 |

*Primary Examiner*—Richard J. Apley
*Assistant Examiner*—Harry Macey
*Attorney, Agent, or Firm*—Robert E. Strauss

[57] ABSTRACT

There is disclosed a portable, hand-held massager in combination with a therapeutic spa. The massager has a fluid motor that is mechanically coupled to a reciprocating massage pad. The fluid motor is detachably connected to the pressured fluid system of the therapeutic spa and, for this purpose, has a sleeve adapter to attach to a fluid jet nozzle in the wall of the therapeutic spa with a flexible hose leading to the fluid motor of the massage unit.

15 Claims, 6 Drawing Figures

PORTABLE SPA MASSAGER

BACKGROUND OF THE INVENTION

Fluid powered brushes, particularly rotary brushes are wellknown as shown in U.S. Pat. Nos. 2,540,240; 2,682,675; 3,906,574; and 4,151,624. Typically, these brushes are connected to faucets of household water systems and have a rotary fan driven by the water pressure. Some brushes are provided with reciprocating piston motors such as in U.S. Pat. No. 3,443,271. These brushes are intended for use as scrub brushes, tooth brushes, and the like.

A shower with a powered scrub brush is disclosed in U.S. Pat. No. 2,026,981. The scrub brush of this device is mounted for reciprocating movement and is driven by a flexible shaft from a remote motor.

Although therapeutic spas have been used for some time and have found recent popularity, the therapeutic action of the spas has depended entirely on the circulation of water in a large tub enclosure which is achieved by one or more fluid jet nozzles positioned in the side walls of the spas. While these spas exhibit a therapeutic action by the vibrating action established in the water of the spa, concentrated or intensified massaging at a localized area of the body such as experienced from an injury or chronic disorder cannot be achieved in these therapeutic spas.

BRIEF DESCRIPTION OF THE INVENTION

This invention comprises the combination of a therapeutic spa including a tub enclosure having a fluid jet system with at least one fluid jet nozzle located in a wall of the tub enclosure and with a pressured fluid system having a fluid pump and motor drive with a fluid distribution conduit to deliver pressured fluid to the fluid jet nozzle. The invention comprises in combination with this therapeutic pool, a portable, hand-held, fluid-powered massager which comprises a casing having an inlet port with a fluid motor mounted therein opposite the inlet port, a massager pad mounted for reciprocating movement on the undersurface of the casing with a drive transmission mechanically coupling the massager pad to the fluid motor and with a sleeve adapter than can be removably attached to one of the wall jet nozzles of the spa and a flexible hose interconnecting the sleeve to the inlet port of the casing whereby the air and water mixture ejected from the fluid jet nozzle can be applied as the motor fluid for the fluid motor of the massager.

Preferably the fluid motor is a water turbine having a multiple-bladed rotor rotatably mounted in the casing with a drive transmission that includes a cam and a lateral cam groove on the massager pad to translate the rotary movement to a reciprocating movement.

BRIEF DESCRIPTION OF THE DRAWINGS

The invention will be described with reference to the figures of which.

DESCRIPTION OF PREFERRED EMBODIMENTS

Figure 1:
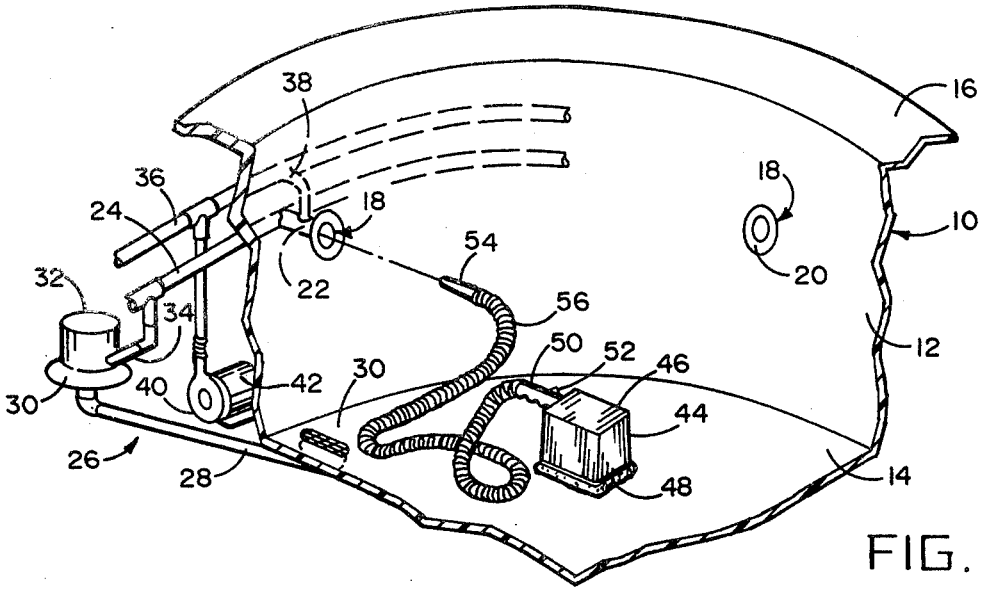
FIG. 1 is a partial perspective view of the spa and portable massager of the invention.

Referring to FIG. 1, there is illustrated a portion of a spa 10 having a general tub enclosure shape with side wall 12 and a bottom wall 14. The side wall has a customary lip 16 about its upper edge and a plurality of fluid jet nozzles generally indicated at 18. Each fluid jet nozzle includes a trim ring 20 on the inside surface of the wall 12 and a nozzle body 22 which communicates with a fluid distribution conduit 24. There are various shapes and designs on the jet nozzles available; typical of jet nozzles are those shown in U.S. Pat. Nos. 3,297,025; 3,745,994; and 4,349,923.

Regardless of the particular jet nozzle employed in the therapeutic spa, the typical therapeutic spa includes a fluid circulation system such as the water circulation system generally indicated as 26 in the figures. This includes a water return line 28 from a drain 30 or similar outlet port of the tub enclosure 10 which leads to a pump, typically a centrifugal pump 40, having a suitable drive 42, typically an electric motor drive. The pump discharge 34 is connected to the water distribution conduit 24, previously described which is in open communication with each of the plurality of jet nozzles 18.

Most of the modern therapeutic spas include a provision for induction of air into the pressure water line immediately prior to discharge of the water as a jet into the spa. This is illustrated in the figure where an air distributor conduit 36 is illustrated with a plurality of branch conduits 38 that extend into open communication with the nozzle portion 22 of the plurality of jet nozzles 18. In some of these applications, the air introduction conduit is positioned at a low pressure point in the jet nozzle and the air is inducted into the nozzle which functions similar to a Venturi. In alternative embodiments, the air is supplied with a blower 40 having a suitable motor drive 42 which supplies a pressured source of air for introduction into the nozzles immediately prior to discharge into the spa.

The massage unit of the invention is generally indicated at 44 and comprises a casing 46 having a vibrating pad undersurface 48 and a dependent handle 50. Preferably, handle 50 also supports a operator 52 for a valve in the fluid supply line to casing 46. The portable massager is interconnected to the spa system by sleeve 54 which can be detachably interconnected to one of the plurality of jet nozzles 18. As illustrated, sleeve 54 has a slightly tapered or conical shape for insertion into the generally conical shape of jet nozzle 18, thereby permitting secure insertion of sleeve 54 to a jet nozzle 18. A flexible hose 56 interconnects sleeve 54 to handle 50 whereby the pressured fluid delivered from the jet nozzle 18 is transmitted to the interior of casing 46 for operation of the fluid motor therein, described hereinafter in greater detail.

Figure 2:
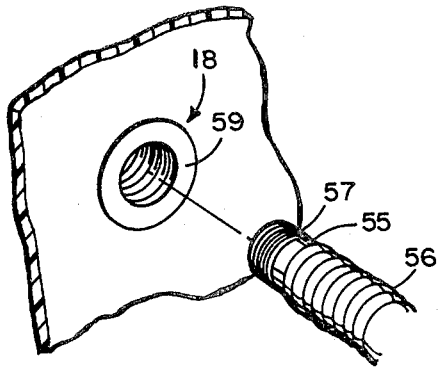
FIG. 2 illustrates an alternative interconnecting sleeve.

Referring now to FIG. 2, an alternative construction is provided for the connecting sleeve 55. As there illustrated, hose 56 carries a sleeve 55 provided with external threads 57. The latter are received within the internally threaded fitting 59 of the jet nozzle 18. This construction is typical of that shown in U.S. Pat. No. 4,349,923 and is a preferred construction because of the secure attachment of the sleeve and portable massage unit 44.

Figure 3:
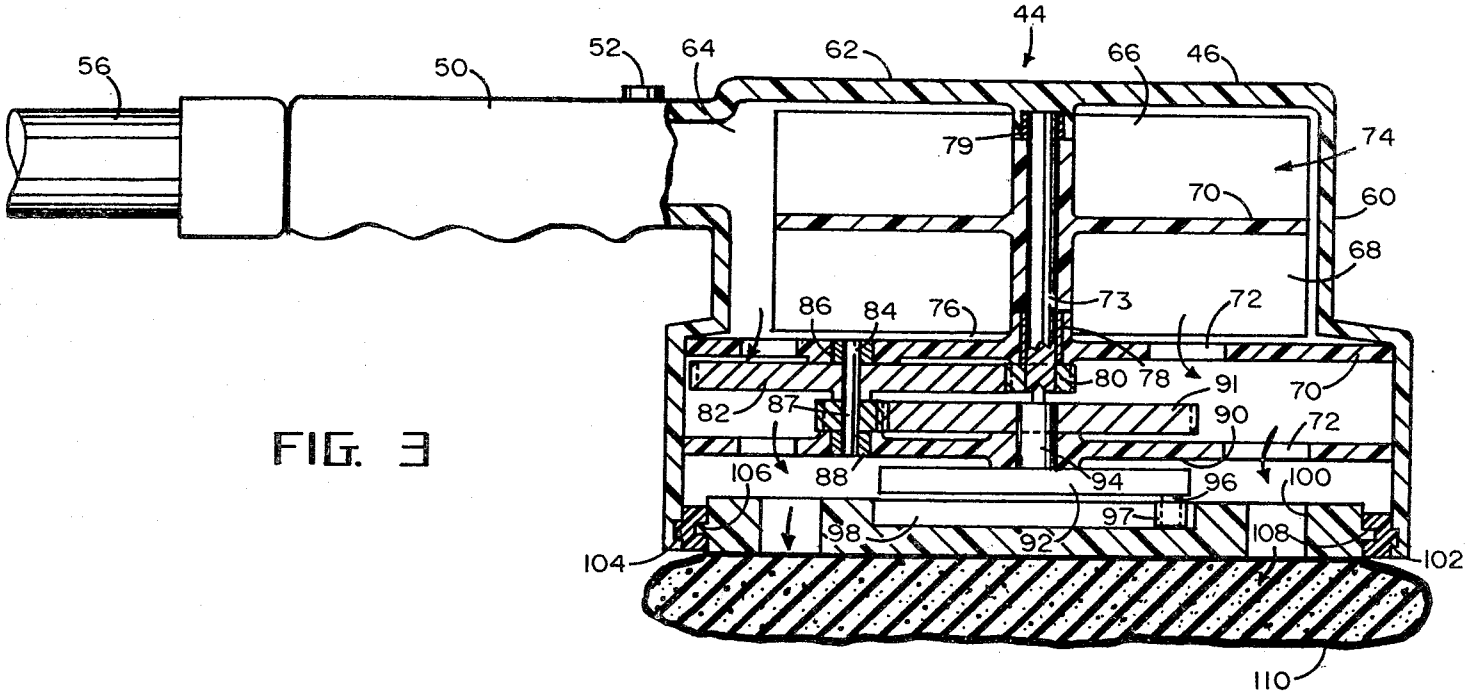
FIG. 3 is a sectional elevational view of the massager used in the invention.

Referring now to FIG. 3, the massage unit 44 is illustrated in greater detail. As illustrated, casing 46 has a generally inverted cup-shape configuration with side walls such as 60 and a top wall 62. The upper portion of the casing 46 has a fluid inlet port 64 which communicates with the hollow interior of handle 50 and with serially connected flexible hose 56. A suitable shut-off valve (not shown) is also included in handle 50 with a button valve operator 52 whereby the fluid supply through handle 50 can be controlled by the user. The fluid under pressure is discharged through the inlet port 64 to impinge against a plurality of curvalinear radial blades 66 and 68 which are mounted on opposite sides of a disk 69 that is rotatably mounted in the casing by its dependent shaft 73. Disk 69 and the plurality of blades 66 and 68 thus provide a turbine blade in casing 46 and, together with the fluid pressure delivery system, provide a fluid motor for operation of the massager unit.

A transverse partition 70 is provided at an intermediate elevation in the casing 44. This partition is perforate, with apertures 72, to permit discharge of the pressured fluid such as water from the motor chamber 74. The shaft of the turbine blade is rotatably mounted in the transverse partition 70, preferably by suitable bearing means 78 and 79 such as a lubricated bronze bushing and the like. Shaft 73 distally supports a spur gear 80 which is meshed with driven gear 82 carried on shaft 84. One end of shaft 84 is received in a suitable bearing 86 in transverse partition 70 and the opposite end supports spur gear 88. A second transverse partition 90, also with perforations 72, is provided beneath transverse partition 70 to provide support for the shafts of the gear transmission means of the massager unit such as shaft 87 which is received in bearing 89. The spur gear 88 is meshed with gear 91 which is rotatably mounted to transverse partition 90 by stub shaft 94, which also can be supported in a bearing. Cam wheel 92 has a cam follower 96 projecting downwardly from its undersurface. The follower 96 can be a pin or can be a roller 97 carried on a shaft that is secured to the cam wheel 92. The lower end of the follower 96 is received in a straight, lateral or transverse slot 98 of the massage pad 100.

The massage pad 100 is mounted for reciprocating movement in the assembly between side rails 102 and 104, each of which have a lateral groove 106 on their inside faces to receive a longitudinal tongue 108 on the mating or coacting edges of the massage pad 100. In a preferred embodiment, massage pad 100 has an undersurface which supports a soft rubber pad 110 that can be formed of a suitable elastomer or, preferably, is formed of a sponge material.

In operation, the release of pressured fluid through the inlet port of the massage unit imparts a high speed rotation to the turbine blade in the motor chamber 76. This movement is transmitted through the transmission gears to the massage pad 110 which reciprocates to provide a suitable massaging action, the intensity of which can be controlled by valve operator 52.

Figure 4:
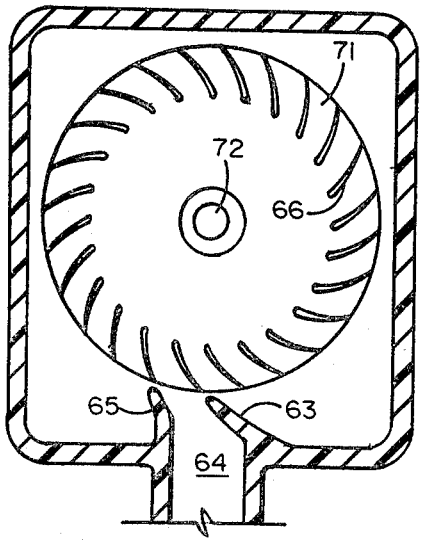
FIG. 4 is a view along lines 4—4 of FIG. 3.

As shown in FIG. 4, the turbine blade 71 has a plurality of radial vanes or blades such as 66 having a slightly arcuate curvature. The inlet port 64 is provided with deflecting baffles 63 and 65 that direct the pressured fluid such as water and air into reaction against the blades 66 of the turbine fan 71. Preferably, baffles 63 and 65 converge slightly as shown to impart a suitable velocity to the fluid discharged against the turbine blades.

Figure 5:
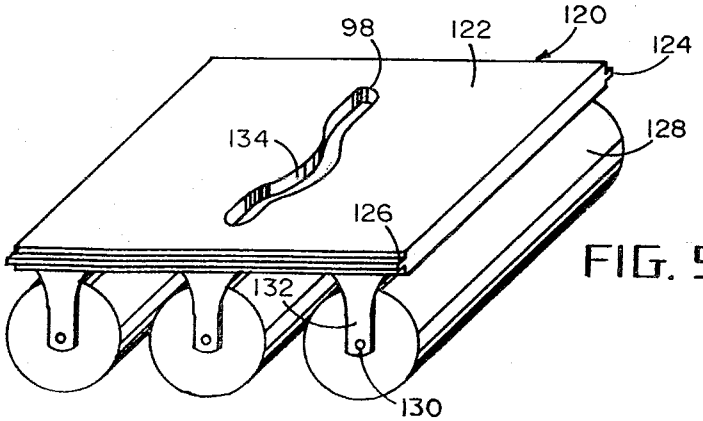
FIG. 5 is a perspective view of an alternative massager

Referring now to FIG. 5, the massage unit can be provided with a replacement massage pad generally indicated at 120. This massage pad includes a plate 122 having longitudinal tongues 124 and 126 for reception in the longitudinal grooves 106 of the opposite side rails 102 and 104 mounted on the bottom edges of the casing 44. The particular massage unit shown in FIG. 5 includes a plurality of rollers 128 that are rotatably mounted on shafts 130 carried by downwardly dependent legs 132 which project from the undersurface of the plate 122. FIG. 5 also illustrates the transverse groove 98 in the plate 122 which receives the cam follower pin 96 as previously described. Preferably, this groove 98 has a slightly curved portion 134 which serves to arrest the motion of the slide momentarily during its reciprocating movement and provides a smoother vibratory action. The cam and slot thus provide what is commonly known as an inverse cam drive relationship.

Figure 6:
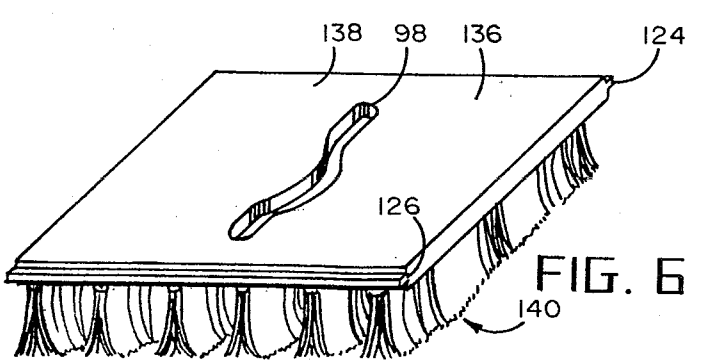
FIG. 6 is a perspective view of a brush for use in the massager unit.

Referring now to FIG. 6, there is illustrated an alternative massage pad 136. This pad has a plate 138 similar to the plate 122 with a transverse cam groove 98 to receive the cam follower pin 96. Plate 136 also has similar longitudinal tongues 124 and 126 to adapt the plate for reciprocating movement mounting in the casing 44. The undersurface of the plate 138 bears a plurality of bristles 140 whereby the massage unit can provide a brushing action.

The invention has been described with reference to the illustrated and presently preferred embodiments. It is not intended that the invention be unduly limited by this disclosure of presently preferred embodiments. Instead, it is intended that the invention be defined by the means, and their obvious equivalents, set forth in the following claims.

What is claimed is:

1. The combination of a therapeutic pool including a tub enclosure having a fluid jet system including at least one fluid wall jet nozzle located in a wall of said tub enclosure, a pressured fluid system with a fluid pump and a motor drive therefor, and a fluid distribution conduit extending between said pump and jet nozzle to deliver pressured fluid thereto, and a portable, hand-held, fluid-powered massager comprising:

(a) a casing having an inlet port in its side wall and a handle dependent therefrom and a flat undersurface;

(b) a vibrator pad slidably mounted to the flat undersurface of said casing for reciprocating movement parallel to said undersurface of said casing;

(c) a fluid motor in the top portion of said casing including an impeller on a shaft in said casing for rotation in a plane parallel to said undersurface of said casting;

(d) drive transmission means mechanically coupling said vibrator pad to said fluid motor including at least two speed reduction stages, each comprising a spur gear and a driven gear, and a cam wheel in driven relationship to the last of said speed reduction stages and mechanically coupled to said vibrator pad to effect reciprocation thereof;

(e) a sleeve adapter to be removably attached to said wall jet nozzle; and (f) a flexible hose connecting said sleeve adapter to said inlet port of said casing through said handle, whereby the fluid ejected from said nozzle can be utilized as the motive fluid for said fluid motor.

2. The combination of claim 1 wherein said fluid jet system includes a water circulation system with a water circulation conduit extending from said tub enclosure through said pump.

3. The combination of claim 2 including an aeration system to introduce air into said water circulation system.

4. The combination of claim 3 wherein said aeration system comprises air ports located at low pressure points of said fluid jet nozzle 5. The combination of claim 3 wherein said aeration system comprises an air blower and an air delivery conduit to admix air into said fluid distribution conduit.

6. The combination of claim 1 wherein said impeller is a turbine with a multiple-bladed rotor rotatably mounted in said casing.

7. The combination of claim 6 wherein said rotor comprises a plurality of curved, radial blades mounted on a rotatable disc.

8. The combination of claim 7 wherein said rotor has a plurality of curved radial blades mounted on opposite sides of a rotatable disc.

9. The combination of claim 1 wherein said handle is hollow and mounted between said inlet port and said flexible hose.

10. The combination of claim 9 including fluid valve means mounted in said handle with a valve operator lever carried on said handle to open and close the delivery of fluid to said fluid motor.

11. The combination of claim 1 wherein said casing is open at its undersurface with longitudinal guides on the opposite lower edges which are received in cooperative grooves in the opposing edges of said vibrator pad whereby said pad is mounted for reciprocal movement onto said casing.

12. The combination of claim 11 wherein said vibrator pad has an undersurface covering of a soft elastomeric material.

13. The combination of claim 11 wherein said vibrator pad has a plurality of laterally mounted rollers mounted on shafts normal to the direction of reciprocation of said vibrator pad.

14. The combination of claim 1 wherein said drive transmission means includes a lateral cam groove on said vibrator pad and a cam pin on the undersurface of said cam wheel linked by said drive transmission means to said driven gear.

15. A vibrator for use in a spa having at least one wall mounted jet nozzle to receive a pressured air and water mixture from a fluid delivery system, comprising:

(a) a casing having an inlet port in its side wall and a handle dependent therefrom and a flat undersurface., (b) a vibrator pad slidably mounted to the flat undersurface of said casing for reciprocating movement parallel to said undersurface of said casing (c) a fluid motor in the top portion of said casing including an impeller on a shaft in said casing for rotation in a plane parallel to said vibrator pad., (d) drive transmission means mechanically coupling said underface of said casting to said fluid motor including at least two speed reduction stages, each comprising a spear gear and a driven gear, and a cam wheel in driven relationship to the last of said speed reduction stages and mechanically coupled to said vibrator pad to effect reciprocation thereof;

(e) a sleeve adapter to be removably attached to said wall mounted jet nozzle; and (f) a flexible hose connecting said sleeve adapter to said inlet port of said casing through said handle, whereby the air and water mixture ejected from said nozzle can be utilized as the motive fluid for said fluid motor.

* * * * *